US005578782A

United States Patent [19]

Masubuchi

[11] Patent Number: 5,578,782

[45] Date of Patent: Nov. 26, 1996

[54] MUSICAL TONE CONTROL DEVICE FOR ELECTRONIC KEYBOARD INSTRUMENT

[75] Inventor: Takemichi Masubuchi, Hamamatsu, Japan

[73] Assignee: Yamaha Corporation, Japan

[21] Appl. No.: 363,386

[22] Filed: Dec. 23, 1994

[30] Foreign Application Priority Data

Dec. 27, 1993 [JP] Japan ..... 5-332066
Dec. 28, 1993 [JP] Japan ..... 5-338507

[51] Int. Cl.[6] ..... G10H 1/055; G10H 1/34

[52] U.S. Cl. ..... 84/687; 84/690; 84/719; 84/720; 84/DIG. 7

[58] Field of Search ..... 84/615, 626, 644, 84/658, 670, 687–690, 719, 720, 723–734, 744, 745, DIG. 7

[56] References Cited

U.S. PATENT DOCUMENTS

| | | | |
|---|---|---|---|
| 1,853,630 | 4/1932 | Martenot | 84/720 X |
| 4,468,999 | 9/1984 | Bonanno | 84/687 |
| 5,164,532 | 11/1992 | Ishii et al. | 84/724 X |
| 5,192,820 | 3/1993 | Kawamura et al. | 84/724 X |
| 5,406,875 | 4/1995 | Tamai et al. | 84/719 X |

FOREIGN PATENT DOCUMENTS

| | | |
|---|---|---|
| 55-43438 | 10/1980 | Japan . |
| 3-35596 | 4/1991 | Japan . |

*Primary Examiner*—Stanley J. Witkowski
*Attorney, Agent, or Firm*—Graham & James LLP

[57] ABSTRACT

An musical tone control device, employed by an electronic keyboard instrument, comprises a keyboard frame, a stopper member and a sensor. The keyboard frame is located beneath an arrangement of keys in the keyboard and is provided to support the keys in a vertical direction as well as in a horizontal direction. The key is normally pressed upward by a key-return spring. The stopper member comprises a base part, a flexible part, having flexibility In a selected direction, and an edge portion which are assembled together. The base part is fixed to the keyboard frame. The edge portion of the stopper member provides at least a lower-limit stopper for the key. The sensor is attached to the flexible part so as to sense a deformation of the stopper member in the selected direction. An output of the sensor is used to control a musical tone in terms of a specific musical parameter such as pitch. When the key is moved vertically so as to depress down the lower-limit stopper, the stopper member is vertically deformed so that the sensor senses a vertical deformation of the stopper member. When the key is moved horizontally, a horizontal motion of the key is transmitted to the stopper member through a key guide, which is provided to regulate the horizontal motion of the key, so that the sensor senses a horizontal deformation of the stopper member. The sensor is configured by a strain gauge or the like.

13 Claims, 12 Drawing Sheets

MUSICAL TONE CONTROL DEVICE FOR ELECTRONIC KEYBOARD INSTRUMENT

BACKGROUND OF THE INVENTION

1. Field of the Invention

The present invention relates to a musical tone control device which controls a musical tone in terms of a specific musical parameter in accordance with a result of the detection for a touch response of the key provided in the electronic keyboard instrument.

2. Prior Art

Conventionally, there is provided a musical tone control device, for an electronic musical instrument, which is disclosed by Japanese Utility-Model Publication No. 55-43438 or the like. This kind of device mainly comprises a shutter mechanism, a pair of detectors and a common light source. Herein, the shutter mechanism contains a pair of shutter plates which operate by being interlocked with swing motions of a keyboard frame in up/down directions as well as in left/right directions, wherein the keyboard frame is provided to support a plenty of keys of the keyboard such that the key can freely move up and down. The common light source radiates light to a pair of detectors while the amount of light radiated is adjusted by a pair of shutter plates respectively. In response to the amount of light received, the detectors generate electric signals which respond to displacement in the swing motion of the keyboard frame. Those electric signals are used as musical tone control signals, by which a certain musical effect realized by the electronic musical instrument is controlled.

The musical tone control device conventionally known has a structure in which the keyboard frame, supported by plate springs, should be swung as a whole. Hence, when the keyboard frame is swung, there is established a movable mechanism whose mass should be equivalent to the total mass of the keys and key-support members. Due to such relatively large mass of the movable mechanism to be established, the conventional device suffers from a bad response. In other words, the conventional device cannot perform the musical-tone control in response to a delicate movement of the key. Or, it is difficult to control the vibrato, whose resonance frequency is low and which gives rapid and minute fluctuations to the pitch.

The conventional device detects the after touch which emerges after the depression of the key. However, it is not possible to detect an initial motion of the key. When the keyboard frame is swung left and right, the conventional device cannot clearly discriminate which direction the keyboard frame is actually swung.

SUMMARY OF THE INVENTION

It is an object of the present invention to provide a musical tone control device, for an electronic keyboard instrument, which is capable of delicately controlling the musical tone to be produced in terms of a specific musical parameter in response to a motion of the key, in a selected direction, with high response.

According to a fundamental construction of the present invention, a musical tone control device, employed by an electronic keyboard instrument, comprises a keyboard frame, a stopper member and a sensor. The keyboard frame is located beneath an arrangement of the keys in the keyboard and is provided to support the keys in a vertical direction as well as in a horizontal direction. The key is normally pressed upward by a key-return spring. The stopper member comprises a base part, a flexible part and an edge portion which are assembled together. The base part is fixed to the lower surface of the keyboard frame. The flexible part has flexibility in a selected direction. The edge portion of the stopper member provides at least a lower-limit stopper for the key. The sensor is attached to the flexible part so as to sense a deformation of the stopper member in the selected direction. Then, an output of the sensor is used to control a musical tone in terms of a specific musical parameter such as pitch.

When the key is moved vertically so as to depress down the lower-limit stopper, the stopper member is vertically deformed so that the sensor senses a vertical deformation of the stopper member. On the other hand, when the key is moved horizontally, a horizontal motion of the key is transmitted to the stopper member through a key guide, which is provided to regulate the horizontal motion of the key, so that the sensor senses a horizontal deformation of the stopper member. If there are provided multiple sensors in the stopper member, outputs of those sensors are added together to produce a signal, by which the musical tone is controlled in terms of the specific musical parameter. Incidentally, the sensor is configured by a strain gauge or the like.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Now, the preferred embodiments of the present invention will be described in detail with reference to the drawings.

[A] First embodiment

Figure 1:
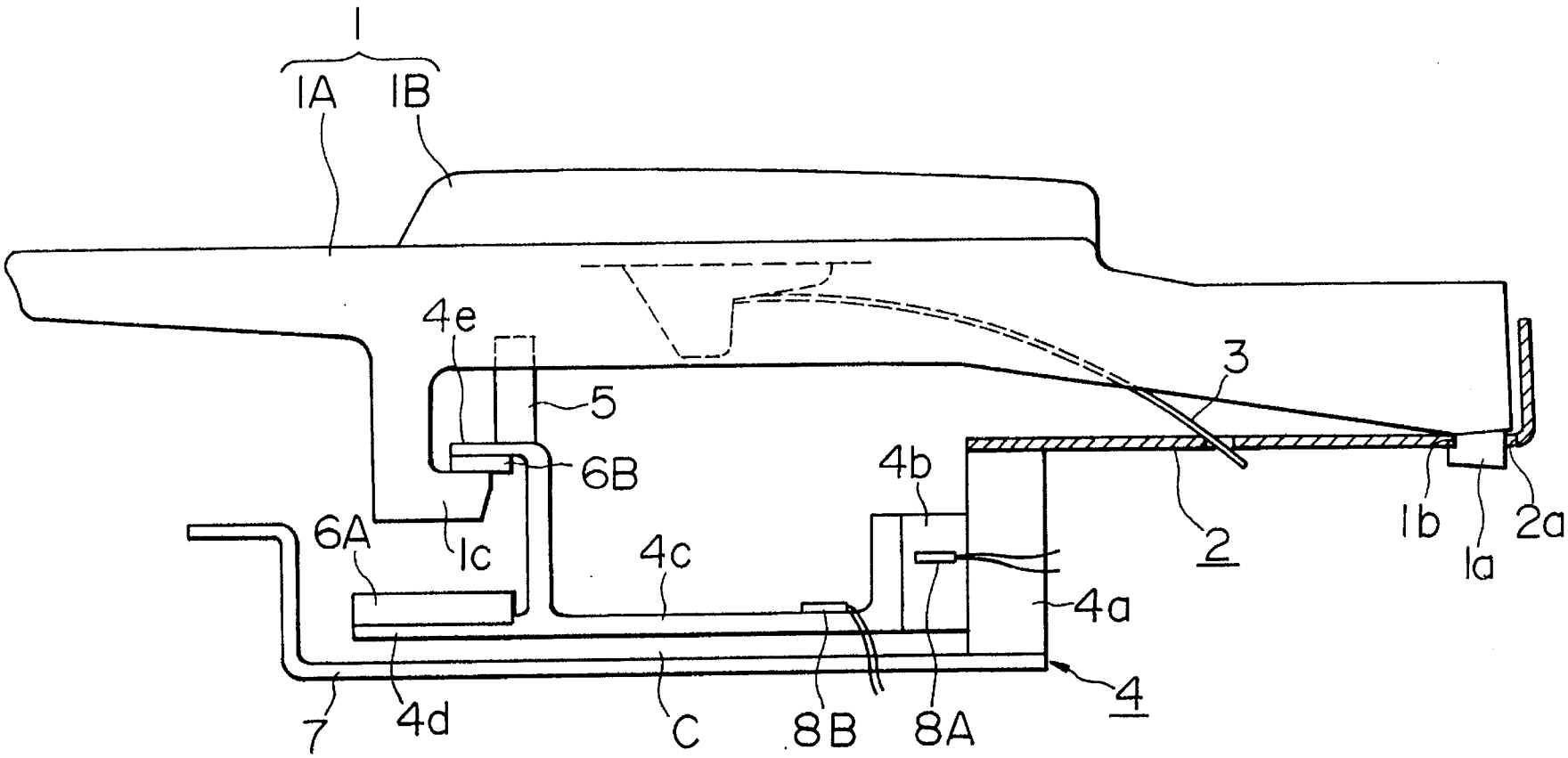
FIG. 1 is a side view illustrating a part of a keyboard which employs a musical tone control device according to a first embodiment of the present invention.
Figure 2:
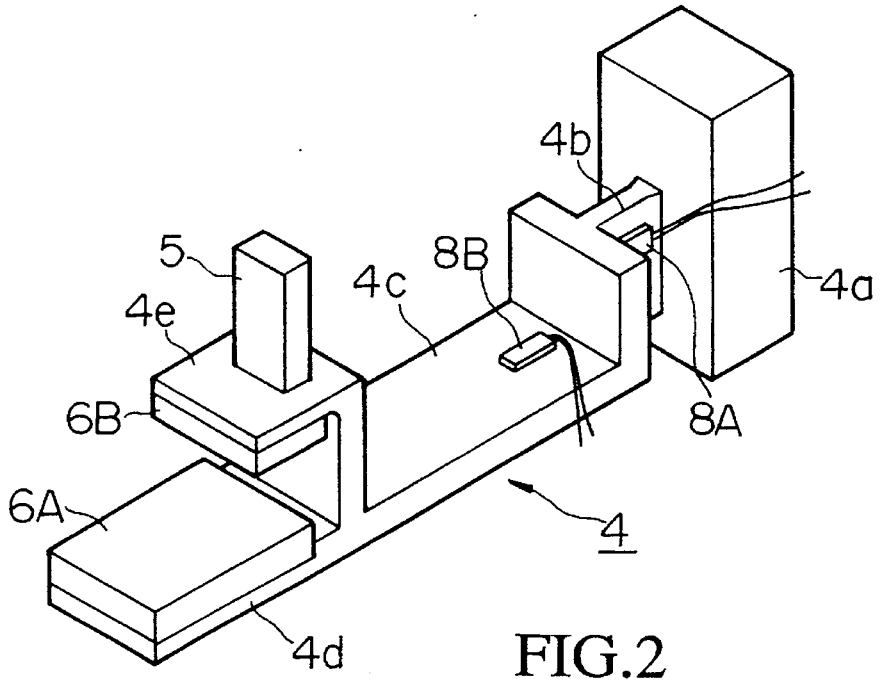
FIG. 2 is a perspective-side view illustrating an exterior structure of a stopper member.

FIG. 1 is a side view illustrating a part of a sectional view of a keyboard, while FIG. 2 is a perspective-side view illustrating a stopper member 4 only. In those drawings, parts, which do not directly relate to the musical tone control device according to a first embodiment of the present invention, are not omitted.

FIG. 1 illustrates a white key 1A and a black key 1B. For convenience's sake, each of those keys is represented by a term "key 1". The key 1 is made by resin material and is formed as shown in FIG. 1. The key 1 provides a projection 1*a* at the back-edge portion thereof, wherein the projection 1*a* works as a supporting point for the key 1 when the key rotably moves up and down.

A recess 1*b* is formed at a front side of the projection 1*a* of the key 1. A through hole 2*a* is formed in a keyboard frame 2 such that the through hole 2*a* has a long shape which is elongated in a lateral direction of the keyboard in which multiple keys are disposed. Hereinafter, the lateral direction of the keyboard will be sometimes called a key-disposing direction. An elongated front edge of the through hole 2*a* engages with recesses of the projections of the keys which are disposed in the lateral direction of the keyboard. Thus, the key 1 can be rotably moved up and down; and the key 1 can be swung left and right in a limited range as well. Further, a key-return spring 3 is provided between the keyboard frame 2 and a ceiling in a hollow part of the key 1. The key-return spring 3 presses the key 1 upward so that the location of the key 1 is normally restored. A stopper element 1*c* projects downward from each of side walls of the key 1 in proximity to a front-edge portion of the key 1. The stopper element 1*c* has a letter "L" like shape.

Meanwhile, a base part 4*a* of the stopper member 4 is securely attached to a lower surface of a front-edge portion of the keyboard frame 2 with respect to each of the keys. The stopper member 4 as a whole is formed as one member which is made by resin material having elasticity. The base part 4*a* is formed as a rigid block. A horizontally-flexible part 4*b*, which has flexibility in the key-disposing direction, is formed at a front face of the base part 4*a*. In addition, a vertically-flexible part 4*c*, which has flexibility in a vertical direction (or a key-depressing direction), is continuously formed with the horizontally-flexible part 4*b*. Further, a lower-limit stopper 4*d* is provided as an extended part of the vertically-flexible part 4*c*, while an upper-limit stopper 4*c* is provided in parallel to the lower-limit stopper 4*d*.

A key guide 5 is planted on an upper surface of the upper-limit stopper 4*e*. The key guide 5 is inserted into the hollow portion of the key between the side walls so as to avoid a lateral motion of the key in the key-disposing direction. Incidentally, the stopper member 4 as a whole has a cantilever-like structure in which the base part 4*a* is securely fixed.

Numerals 6A and 6B are members which are made by shock-absorbing material such as the felt. The felt member 6A is adhered to an upper surface of the lower-limit stopper 4*d*, while the felt 6B is adhered to a lower surface of the upper-limit stopper 4*e*. When the stopper element 1*c* of the key 1 comes in contact with each of the felt members 6A or 6B, the locations of which are respectively set by the lower-limit stopper 4*d* and the upper-limit stopper 4*e*, a vertical motion of the key 1 is limited. Moreover, a common sub-frame 7 is provided with being securely fixed to lower surfaces of the base parts of the stopper members which are disposed along the key-disposing direction. There is formed a gap 'C' between the common sub-frame 7 and a common lower surface of the stopper member 4 along which the horizontally-flexible part 4*b*, the vertically-flexible part 4*c* and the lower-limit stopper 4*d* are continuously formed.

A strain gauge 8A is attached to a side wall of the horizontally-flexible part 4*b* in proximity to the base part 4*a*. This strain gauge 8A detects force, which is horizontally applied to the stopper member 4 (or which is applied to the stopper member 4 in the key-disposing direction), so as to convert it into an electric signal. In addition, another strain gauge 8B is attached to an upper surface of the vertically-flexible part 4*c* in proximity to the base part 4*a*. The strain gauge 8B detects force, which is vertically applied to the stopper member 4, so as to convert it into an electric signal. The signals outputted from the strain gauges 8A and 8B are supplied to an amplifier (not shown).

Figure 3A:
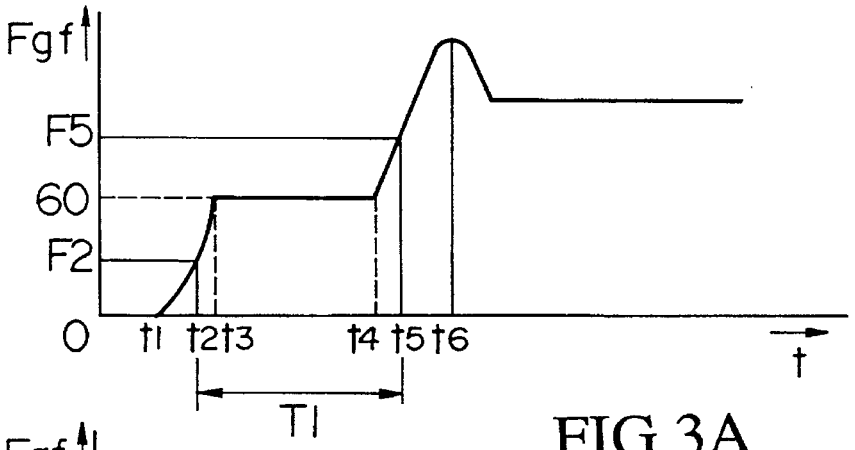
FIGS. 3A and 3B are graphs, each of which shows variation of vertical force, which is effected in the vertical direction on the stopper member, in a lapse of time.
Figure 3B:
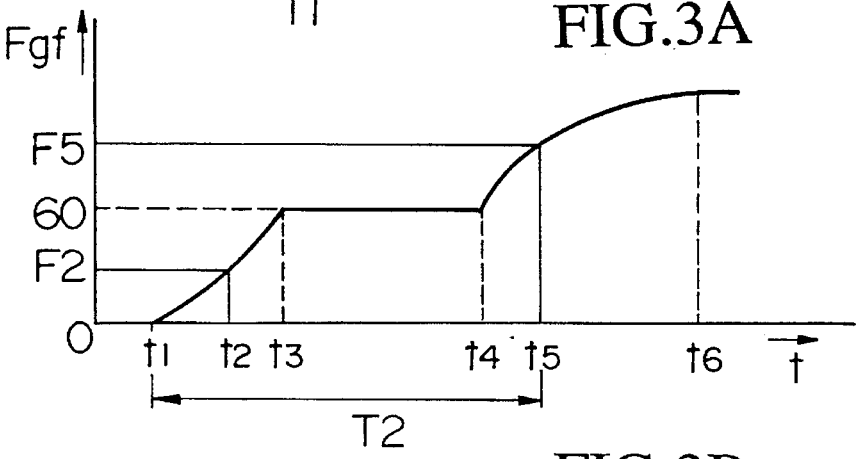

Next, the operations of the first embodiment will be described. When the key 1 is depressed, the depressing force is applied to the stopper member 4. FIGS. 3A and 3B show two kinds of graphs, each of which shows a characteristic curve, in connection with the depressing force applied to the stopper member 4, wherein the depressing force alters in level in a lapse of time after a start timing of the key depression.

FIG. 3A shows the characteristic curve regarding the depressing force which is created by the normal depression of key. In the non-key-depression state in which no depressing force is created, the key 1 is pressed upward by the key-return spring 3 (see FIG. 1), wherein pressing force, which is applied to the key 1 by the key-return spring 3, is roughly equivalent to '60 gf', for example. In that state, the force, which is almost identical to the pressing force produced by the key-return spring 3, is effected upward on the upper-limit stopper 4*e* of the stopper member 4 through the stopper element 1*c*.

When the depression of the key 1 is started in the non-key-depression state, an upper edge portion of the stopper element 1*c* of the key 1 starts to depart from the felt member 6B of the upper-limit stopper 4*e* when time 't1' is passed after a key-depression-start moment '0' in FIG. 3A. When time 't3' elapsed, the stopper element 1*c* perfectly departs from the upper-limit stopper 4*e*. During the time t3, upward force applied to the upper-limit stopper 4*e* is gradually reduced. When the time t3 elapsed, the depressing force reaches '60 gf'. Thereafter, the upward force applied to the upper-limit stopper 4*e* becomes equal to zero. Thus, the stopper member 4 is affected by a certain downward force corresponding to its own weight, so that the lower-limit stopper 4*d* is subjected to slight displacement in the downward direction. Correspondingly, a tip-edge portion of the vertically-flexible part 4*c* is slightly bent downward.

When time 't4' elapsed, a lower edge portion of the stopper element 1*c* comes in contact with the felt member 6A of the lower-limit stopper 4*d*. When the depression of the key 1 is relatively hard like a beating, downward force effected on the stopper member 4 sharply increases after a lapse of time t4 as shown in FIG. 3A. When time t6 elapsed, the downward force reaches the maximum. After the instantaneous maximum, the downward force is reduced to a certain level of force which corresponds to the after touch.

In contrast to the normal depression of key, as shown in FIG. 3A, when a soft depression of key is effected on the key 1, the characteristic curve is changed as shown in FIG. 3B. Herein, after a lapse of time t4, the downward force gradually increases; and when time t6 elapsed, the downward force reaches the certain level of force which corresponds to the after touch. The times t1 to t6, shown in FIG. 3A, are different from the times t1 to t6 shown in FIG. 3B.

A slope in a rising portion of the characteristic curve in times t1–t3, shown in FIG. 3A is relatively sharp, while a slope in a rising portion of the characteristic curve in times t1–t3, shown in FIG. 3B, is relatively gentle. In both graphs of FIGS. 3A and 3B, the downward -force reaches level 'F2' at time t2, while the downward force reaches level 'F5' at time t5. Passing time 'T1' emerges between the moments 't2' and 't5' in FIG. 3A, while another passing time 'T2' emerges between the moments 't2' and 't5' in FIG. 3B. The passing time T1 is shorter than the passing time T2. It is possible to detect the key-depressing speed based on the passing time.

Incidentally, if the depressing pressure, which is generated at the key-depression timing or after the key-depression timing, contains horizontal components, i.e., left-directional and right-directional components, the depressing force should be transmitted to the stopper member 4 through the key guide 5. Hence, the stopper member 4 is bent in the key-disposing direction by means of the horizontal-flexible part 4*b*.

The characteristic curve for the above-mentioned depressing force is roughly equivalent to the characteristic curve as shown in FIG. 3A or 3B, except for relevance to the weight of the stopper member 4. In other words, the characteristic curve of the depressing force can be represented by the characteristic curve, shown in FIG. 3A, except a certain portion between the moments t1 to t3.

In general, the force 'F' which is effected on a specific point in proximity to the tip-edge portion of the cantilever like the stopper member 4, has a proportional relationship with the bending moment 'M' of the beam. The bending moment M is proportional to the product of the section modulus 'Z' and stress 'σ'. In addition, resistance variation ΔR of the strain gauge, which is arranged on the bent surface of the beam is proportional to the stress σ.

More specifically, the following equations are established:

$$M=Z\times\sigma$$

$$\sigma=k\times\Delta R$$

where 'k' is a constant which is set by the modulus of longitudinal elasticity and Poisson's ratio for the material which makes the beam.

Therefore, if the bending moment M is applied to the strain gauge 8B (see FIGS. 1 and 2) so that the resistance variation ΔR is produced, the following equation is established:

$$M=Z\times k\times\Delta R$$

If the vertical force, which is transmitted to the stopper member 4 by the depression of the key 1, is represented by 'F', the vertical force F is proportional to the depressing force. Further, the following equation is established:

$$M=F\times D$$

where 'D' represents the distance to be measured between the strain gauge 8B and the contact point at which the stopper member 4 comes in contact with the stopper element 1*c* of the key 1.

By using the above-mentioned equations, it is possible to make an equation, as follows:

$$Z\times k\times\Delta R=F\times D$$

This equation can be expanded, as follows:

$$F=(Z\times k\times\Delta R)/D$$

The above equation indicates that the vertical force F, which is effected on the stopper member 4 in the vertical direction by the depression of the key 1, is proportional to the resistance variation ΔR of the strain gauge 8B.

In general, when the force F is applied to the free-terminal portion of the cantilever, the cantilever is subjected to displacement in the certain direction in which the force F applies. In that ease, the amount of displacement of the cantilever is proportional to the force F. Therefore, the amount of vertical displacement of the stopper member 4 in the vertical direction is proportional to the force F. As described before the force F is proportional to the resistance variation ΔR of the strain gauge 8B. Hence, the output signal of the strain gauge 8B is proportional to both of the force F, which is also proportional to the depressing force, and the amount of vertical displacement of the stopper member 4.

As similar to the strain gauge 8B, the output of the strain gauge 8A is proportional to the horizontal force, which is applied to the stopper member 4 in the key-disposing direction by the depression of the key 1, as well as the amount of horizontal displacement of the stopper member 4. In addition, the polarity (i.e., positive or negative sign) in the output signal of the strain gauge 8A indicates the direction (i.e., left direction or right direction) in which the horizontal force is applied to the stopper member 4.

The output signals of the strain gauges 8A and 8B are supplied to the amplifier (not shown); and then, the output signals amplified are converted into digital signals by the AD converter. The digital signals are supplied to musical-tone-signal control means (not shown). The musical-tone-signal control means performs a variety of control operations on the musical tones with respect to the tone volume, tone pitch, tone color and the like.

For example, the tone color can be controlled in response to the depressing force. If the depressing force is represented by the characteristic curve, shown in FIG. 3A, in which a relatively sharp slope is formed at the rising portion, the cut-off frequency of the low-pass filter (not shown) is increased so that the tone color is changed to offer somewhat brighter sound quality. On the other hand, if the depressing force is represented by the characteristic curve, shown in FIG. 3B, in which a relatively gentle slope is formed at the rising portion, the cut-off frequency of the low-pass filter is decreased so that the tone color is changed to offer somewhat darker sound quality.

In addition, the reverberation to be imparted to the musical tone can be controlled in response to the depressing force. For example, if the key is depressed fast and strongly so that the shock of depression applied to the felt member 6A of the lower-limit stopper 4*d* is large as shown in FIG. 3A, the reverberation is made deep (or sharp). In contrast, when the shock of depression is small as shown in FIG. 3B, the reverberation is made slight (or flat).

Incidentally, it is possible to further apply the horizontal force to the key 1 at the key-depression timing or after the key-depression timing. In that case, the resistance of the strain gauge 8A is varied in proportional to the amount of the horizontal force applied to the key 1. Thus, it is possible to realize the musical technique, called "vibrato", which gives expressive quality to note by rapid and minute fluctuations of pitch, with high response.

According to the first embodiment described heretofore, one strain gauge 8B, which is attached to the vertically-flexible part 4*c*, can detect all components of vertical force which are applied to the stopper member 4 at the initial stage and last stage in the depression of key and at the after-touch timing respectively. In addition, one strain gauge 8A, which is attached to the horizontally-flexible part 4*b*, can detect all components of horizontal force which are applied to the stopper member 4 in the progress of the depression of key and after the depression of key respectively. Moreover, it is possible to easily discriminate the direction (i.e., left direction or right direction) in which the horizontal force is effected.

[B] Second embodiment

Figure 4:
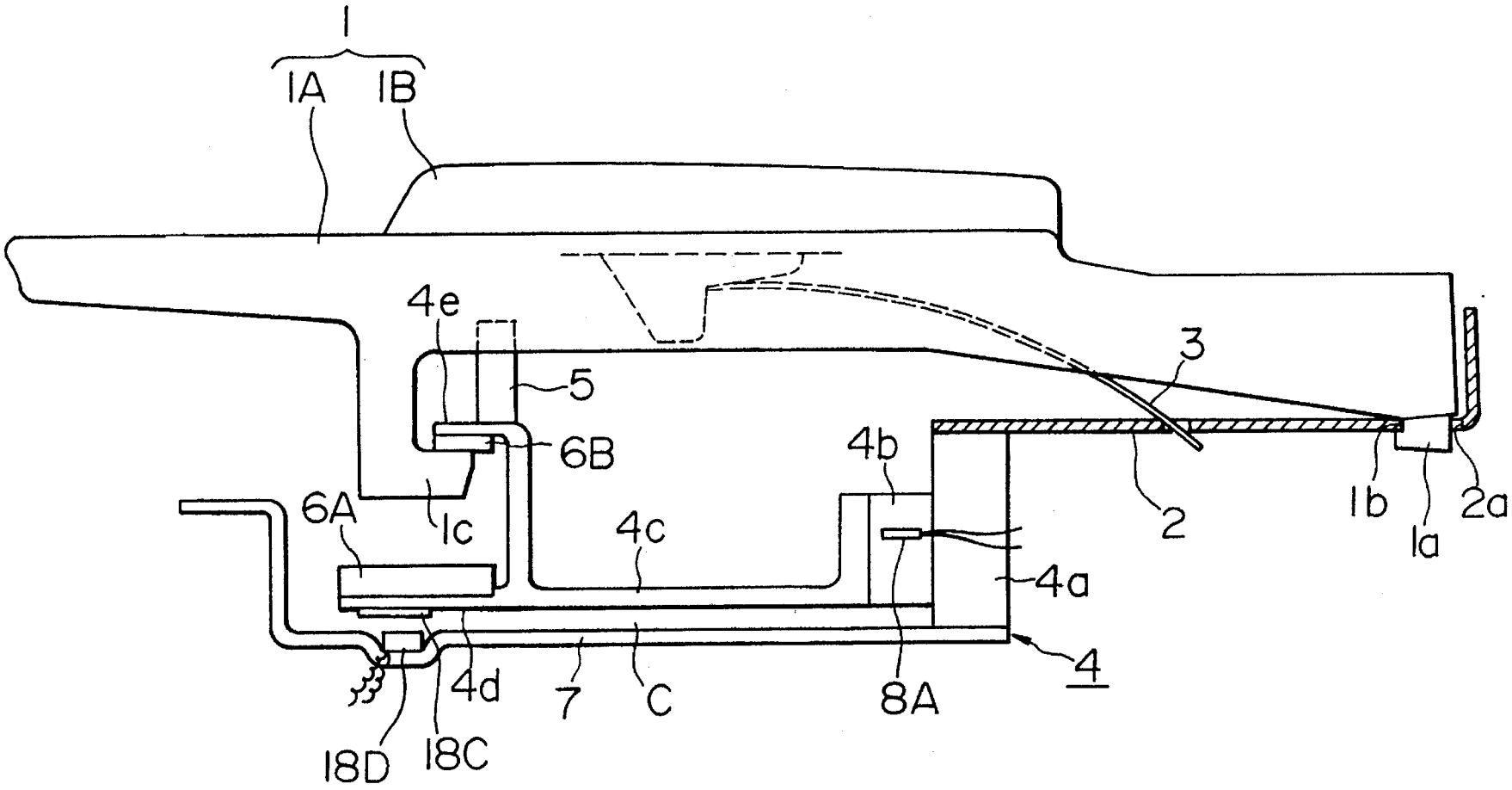
FIG. 4 is a side view illustrating a part of a keyboard employing a musical tone control device according to a second embodiment of the present invention.

FIG. 4 shows a second embodiment which is made by partially modifying the first embodiment. In FIG. 4, the parts corresponding to those shown in FIG. 1 will be designated by the same numerals; hence, the description thereof will be omitted.

As compared to the first embodiment, the second embodiment is characterized by that a reflection plate 18C, such as an aluminum plate, is attached to the lower surface of the lower-limit stopper 4*d* which is formed in the tip-edge portion of the stopper member 4, while a photo sensor 18D, consisting of a pair of light-receiving element and light-emitting element, is arranged on the common sub-frame 7 at the specific location which faces with the reflection plate 18C. The light emitted from the light-emitting element is reflected by the reflection plate 18C and is transmitted to the light-receiving element. Hence, the output of the photo sensor 18D is proportional to the distance between the photo sensor 18D and the reflection plate 18C.

Now, when the key 1 is depressed, the upper-edge portion of the stopper element 1*c* of the key 1 starts to depart from the felt member 6B of the upper-limit stopper 4*e*, so that the upward force, which is applied to the upper-limit stopper 4*e* in the upward direction by the key-return spring 3, is gradually reduced. When the stopper element 1*c* perfectly departed from the upper-limit stopper 4*e*, the upward force becomes equal to zero. Thus, the lower-limit stopper 4*d* of the stopper member 4 is slightly deformed in the downward direction by its own weight. Since the distance between the reflection plate 18C and the photo sensor 18D is changed by the downward displacement of the lower-limit stopper 4*d*, the output signal of the photo sensor 18D is changed. Thereafter, the stopper element 1*c* comes in contact with the felt member 6A of the lower-limit stopper 4*d*. After that, the downward force is effected on the lower-limit stopper 4*d* of the stopper member 4, so that the output signal of the photo sensor 18D is changed further.

As described before, the amount of displacement of the stopper member 4 is proportional to the depressing force applied to the key 1. The variation in the output signal of the photo sensor 18D in connection with the manner of depression to the key 1 (e.g., beating the key or slightly depressing the key) can be easily understood by the description of the first embodiment. As similar to the first embodiment, the second embodiment also provides the strain gauge 8A which detects the horizontal force appeared in the key-disposing direction.

The second embodiment described above employs the photo sensor 18D as the sensor which senses the amount of vertical displacement of the stopper member 4. Instead of the photo sensor 18D, it is possible to employ the magnetic-grid sensor, magnetic-resistance sensor or other magnetic sensors such as the Hall-effect sensor as well as the electrostatic-capacity sensor.

The second embodiment can be modified such that the strain gauge 8A is replaced by one of the above-mentioned sensors, which is attached to the horizontally-flexible part 4*b*, so as to sense the horizontal force applied to the key 1.

The second embodiment is advantageous in that the precision of detection for the amount of displacement of the stopper member 4 can be improved because the amount of displacement is sensed at the tip-edge portion of the stopper member 4 at which the amount of displacement appears relatively large.

[C] Third embodiment

Figure 5:
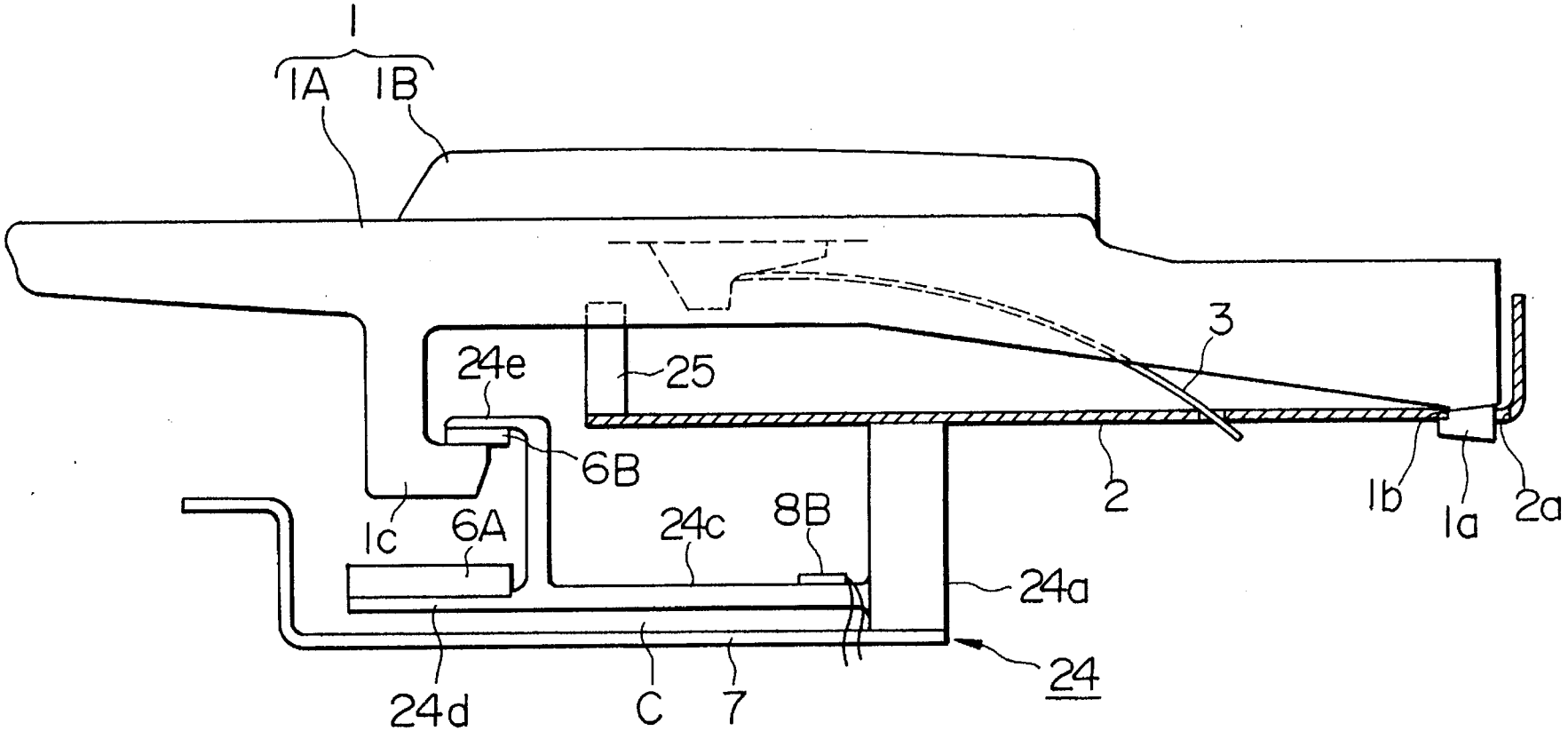
FIG. 5 is a side view illustrating a part of a keyboard employing a musical tone control device according to a third embodiment of the present invention.

FIG. 5 shows the third embodiment of the present invention. As compared to the first embodiment, the third embodiment employs a stopper member 24 instead of the stopper member 4 shown in FIG. 1. In addition, the keyboard frame 2 is extended in the direction of the tip-edge portion of the key 1, while the key guide 25 is planted on that keyboard frame extended.

The stopper member 24 is constructed by a base part 24*a*, a vertically-flexible part 24*c*, a lower-limit stopper 24*d* and an upper-limit stopper 24*e*. The vertically-flexible part 24 has flexibility in the vertical direction. The strain gauge 8B is attached on an upper surface of the vertically-flexible part 24 in proximity to the base part 24*a*.

As compared to the first embodiment, the third embodiment shown in FIG. 5 does not provide the construction element for detecting the horizontal force applied to the key 1. Hence, the construction of the third embodiment is simple. The third embodiment is effective to simply control the musical tones in response to the depressing force applied to the key 1 in the vertical direction only.

Incidentally, the third embodiment can be further modified to sense the amount of vertical displacement of the stopper member 24 by some sensing member which is similar to that of the second embodiment.

[D] Fourth embodiment

Figure 6:
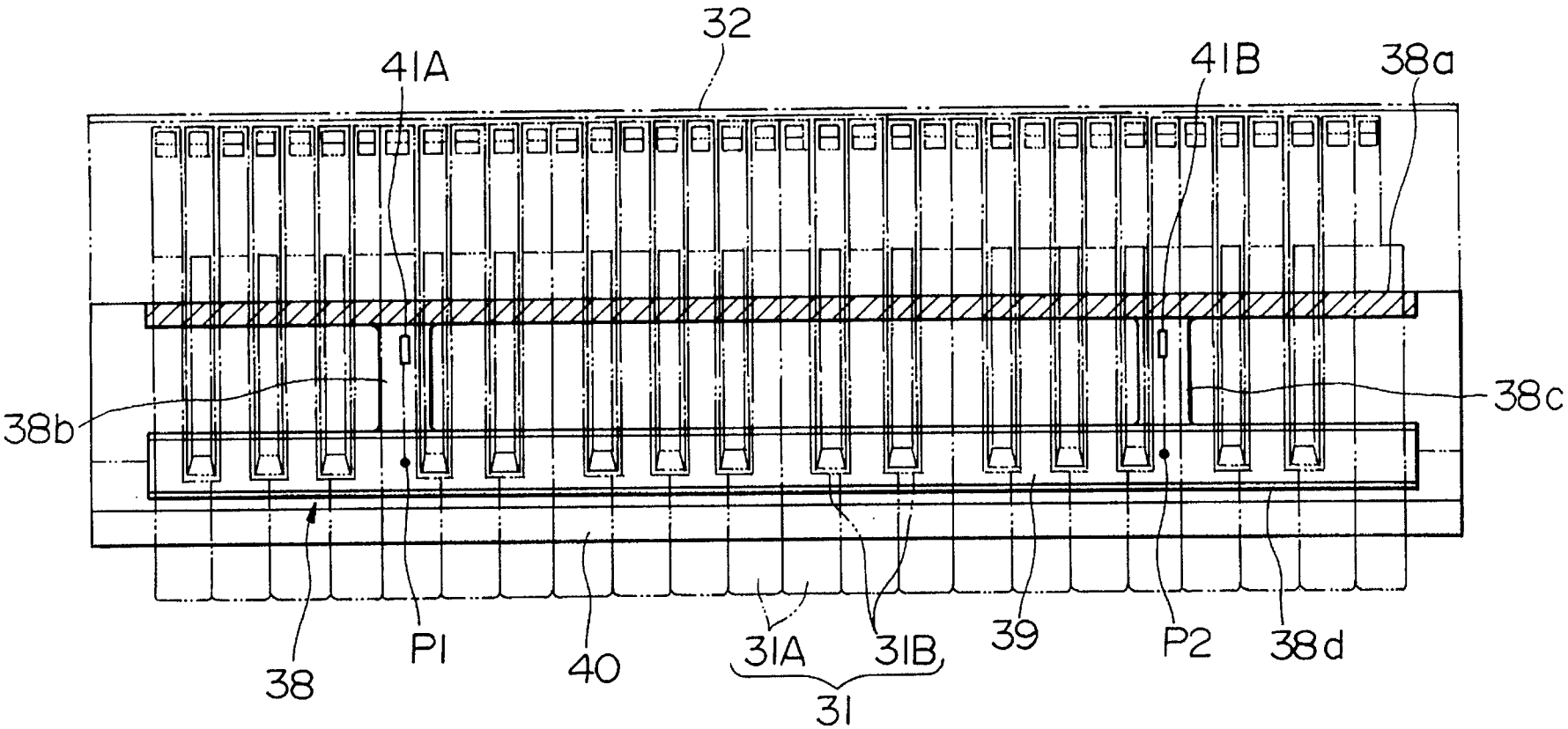
FIG. 6 is a plan view offering a sectional view for a keyboard with respect to a line A—A in FIG. 7.
Figure 7:
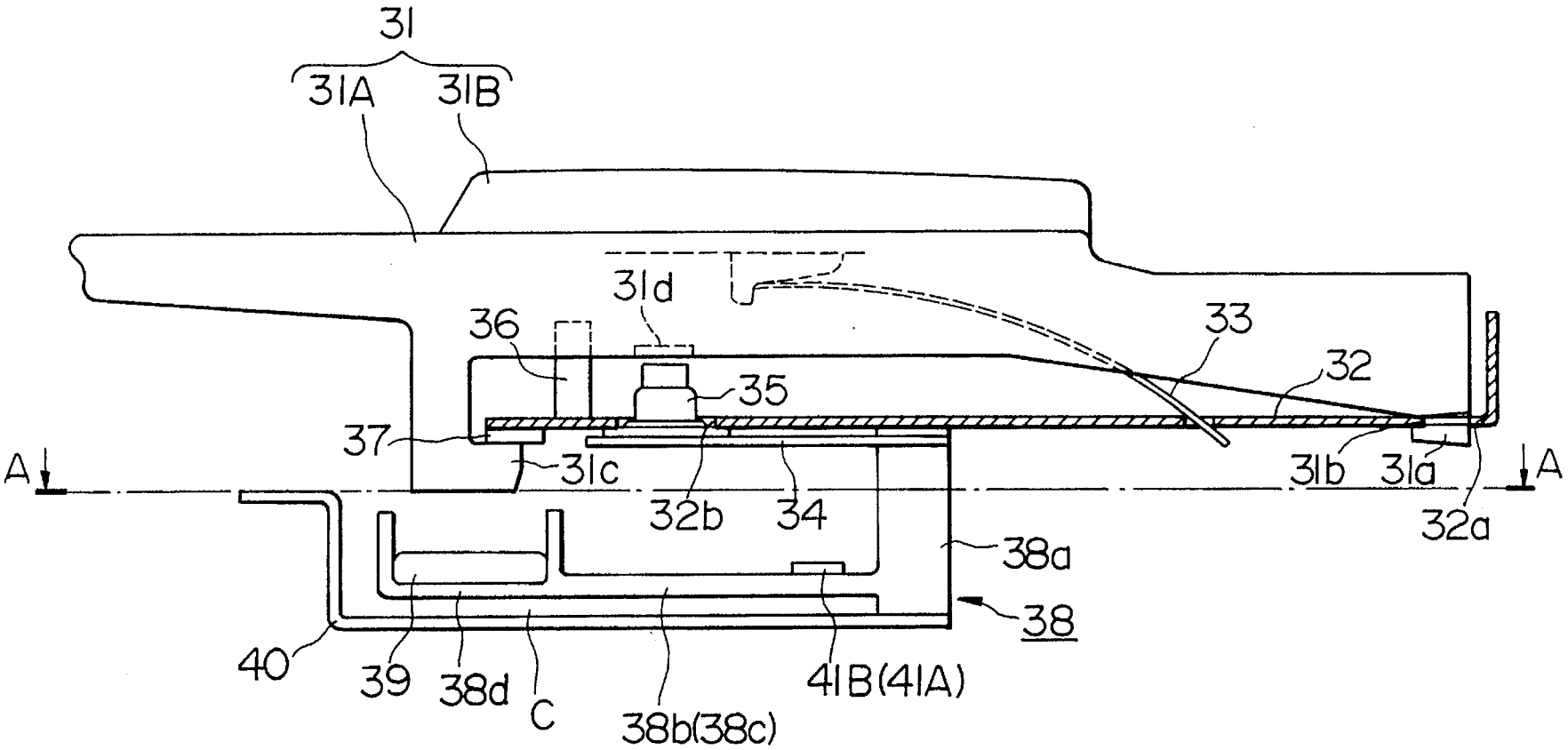
FIG. 7 is a side view illustrating a mechanical structure of a keyboard which employs a musical tone control device according to a fourth embodiment of the present invention.

FIG. 7 is a side view illustrating a part of a keyboard which employs a musical tone control device according to a fourth embodiment of the present invention. FIG. 6 is a plan view of the keyboard, which especially offers a sectional view, for the keyboard shown in FIG. 7, with respect to a line A—A.

As similar to the aforementioned keyboards, there are provided a plenty of keys, containing a white key 31A and a black key 31B, each of which is represented by a term "key 31". A projection 31*a* is located at the back-edge portion of the key 31. A recess portion 31*b*, which is formed at a front portion of the projection 31*a*, engages with a front-edge portion of a through hole 32*a*. Thus, the key 31 can rotably move in up/down directions freely while being supported by a keyboard frame 32. A key-return spring 33 applies pressing force to the key 31 so that the key 31 is normally pressed upward. Further, a stopper element 31*c* projects downward from the lower surface of the key 31 in proximity to its front-edge portion.

A substrate 34 is securely attached to a lower surface of the keyboard frame 32. A rubber-contact member 35, having flexibility, which provides a projecting portion having a round shape, is attached on the substrate 34 in connection with each of the keys. A main portion of the rubber-contact member 35 is inserted through a hole 32*b* of the keyboard frame 32. An actuator 31*d* is provided in the key 31 in connection with the rubber-contact member 35. The rubber-contact member 35 contains a movable contact therein, while a pair of non-conductive fixed contacts are formed, under the rubber-contact member 35, on the substrate 34. Those contacts (not shown) configure a key switch. Hence, when the key 31 is depressed so that the actuator 31*d* depresses down the projecting portion of the rubber-contact member 35, the movable contact comes in contact with the fixed contacts on the substrate 34 so that the key switch is turned on. When the key switch is turned on, a musical tone is produced.

A part of the keyboard frame is cut and is set up to form a key-guide element in front of the rubber-contact member 35. The key-guide element is subjected to outsert process with sound absorbing material such as soft elastomer and foaming material. In other words, the sound absorbing material is formed around the peripheral portion of the key-guide element to form a key guide 36. The key guide 36 is inserted into the space between the side walls of the key 31 so as to avoid the lateral swinging motion of the key 31. Moreover, a felt member 37 is adhered to a lower surface of the keyboard frame 32 at its front-edge portion which acts as an upper-limit stopper as well. The felt member 37 is located to come in contact with an upper-edge portion of the stopper element 31*c*.

Further, there is provided a stopper member 38, whose base part 38*a* is securely fixed to the lower surface of the keyboard frame 32 at its roughly center portion. The base part 38*a* has a square-pole-like shape, whose longitudinal portion is arranged in the key-disposing direction (see hatched part in FIG. 6). A pair of beams 38*b* and 38*c* are formed together with the base part 38*a* of the stopper member 38 in such a manner that the beams 38*b* and 38*c* are located in proximity to both-edge portions of the base part 38*a* in its longitudinal direction. Each of the beams 38*b* and 38*c* has flexibility in the vertical direction. A lower-limit stopper 38*d* is formed with beams 38*b* and 38*c* in such a manner that the lower-limit stopper 38*d*, in its longitudinal direction, is located in parallel with the base part 38*a*. The lower-limit stopper 38*d* has a square-pole-like shape but the sectional area thereof is three-sided as shown in FIG. 7.

A felt member 39 is adhered to a bottom of a hollow portion of the lower-limit stopper 38*d*. When the key 31 is depressed, a lower-edge portion of the stopper element 31*c* comes in contact with the felt member 39 of the lower-limit stopper 38*d*. A common sub-frame 40, having high rigidity, is located beneath the stopper member 38 in such a manner that a part of the common sub-frame 40 is securely fixed with a lower surface of the base part 38*a*. The common sub-frame 40 is located such that a gap 'C' is formed between an upper surface of the common sub-frame 40 and a common lower surface for the beams 38*b*, 38*c* and the lower-limit stopper 38*d*. In addition, strain gauges 41A and 41B are arranged respectively on upper surfaces of the beams 38*b* and 38*c* in proximity to the base part 38*a*. Outputs of those strain gauges 41A and 41B are added together by a circuitry shown in FIG. 10A or 10B, which will be described later.

Figure 8:
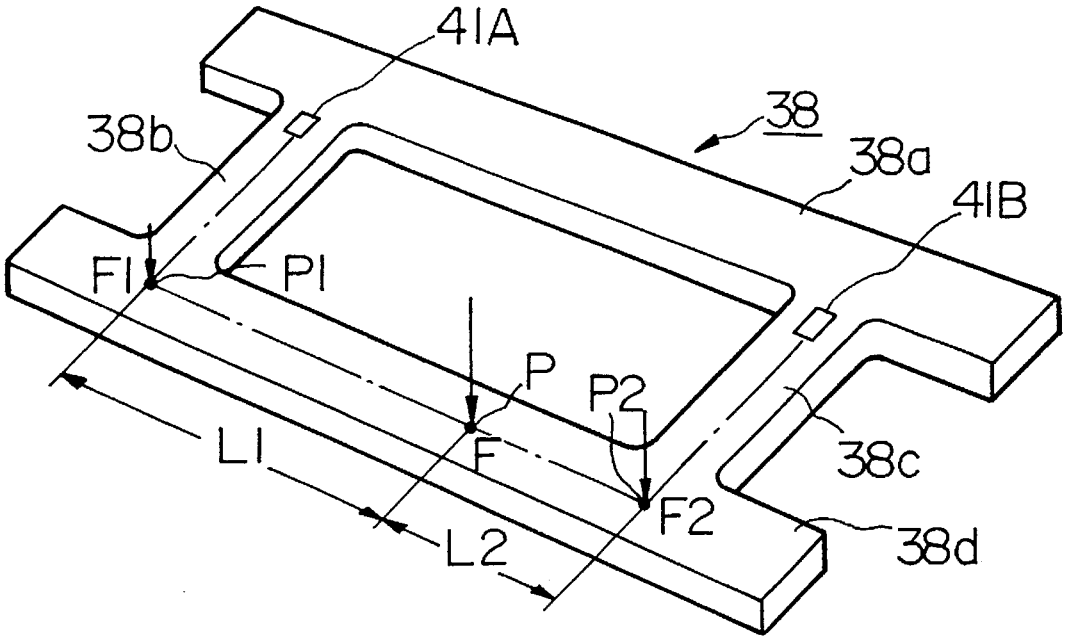
FIG. 8 is a perspective-side view illustrating an equivalent member for a stopper member employed by the keyboard shown in FIG. 7.

Next, the operations of the fourth embodiment will be described. Before specifically describing the operations, the working principle of the fourth embodiment will be described in detail with reference to FIGS. 8, 9A and 9B. FIG. 8 illustrates an equivalent member whose construction is equivalent to that of the stopper member 38. For convenience's sake, the same numerals for the constituent elements of the stopper member 38 are used for constituent elements of the equivalent member shown in FIG. 8. Therefore, the equivalent stopper member 38 shown in FIG. 8 consists of the base part 38*a*, the beams 38*b*, 38*c*, the lower-limit stopper 38*d* and the strain gauges 41A, 41B.

The working principle is explained using a model shown in FIG. 8, in which load 'F' is effected at a point 'P' on the lower-limit stopper 38*d* between the beams 38*b* and 38*c*. Herein, a dashed line is drawn, using the point P, on the lower-limit stopper 38*d* in its longitudinal direction. Another dashed line, which is drawn on the beam 38*b* in connection with the location of the strain gauge 41A, meets with the above dashed line at a point of intersection 'P1'. Similarly, a dashed line, which is drawn on the beam 38*c* in connection with the location of the strain gauge 41B, meets with the above dashed line at a point of intersection 'P2'. A distance 'L1' appears between the points P and P1, while a distance 'L2' appears between the points P and P2. When using a force-distribution model shown in FIG. 9A, downward forces 'F1' and 'F2' are distributed at the points P1 and P2 respectively by the load F. Those forces F1 and F2 can be calculated by the following equations.

$$F1=L2\times F/L1+L2$$

$$F2=L1\times F/L1+L2$$

The sum of the forces F1 and F2 described above can be calculated, as follows:

$$F1+F2=L2\times F/L1+L2+L1\times F/L1+L2=F$$

Figure 9A:
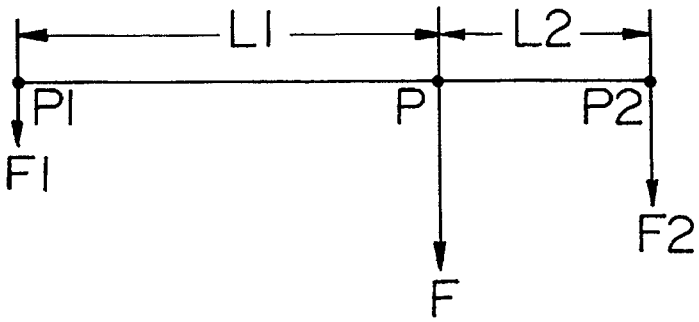
FIGS. 9A and 9B are drawings showing force-distribution models which are used to explain the operations of the stopper member.
Figure 9B:
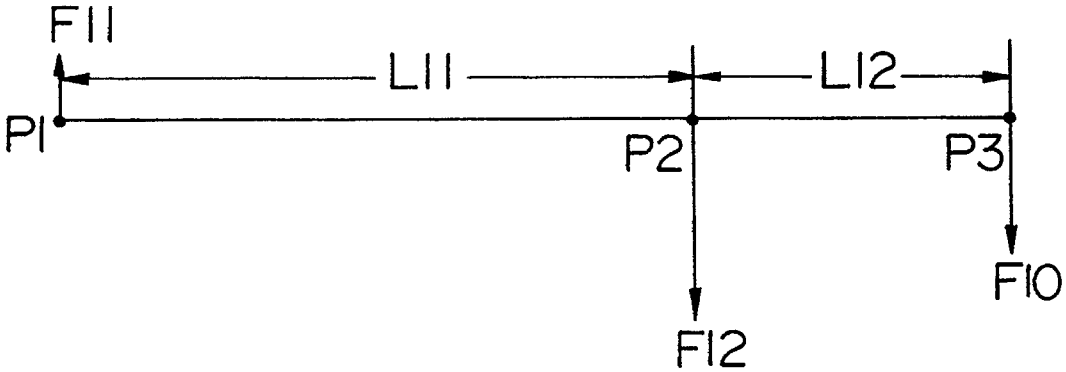

FIG. 9B shows another force-distribution model. In this model, a load 'F10' is effected at a point 'P3' which is located outside the lower-limit stopper 38*d* but is on an extension of the dashed line passing through the aforementioned points P1 and P2; and a distance L11 appears between the points P1 and P2, while a distance L12 appears between the points P2 and P3. Due to the load F10 effected at the point P3, an upward force 'F11' is distributed at the point P1, while a downward force 'F12' is distributed at the point P2. Those forces F11 and F12 can be calculated by the following equations.

$$F11=-L12\times F10/L11$$

$$F12=(L11+L12)\times F10/L11$$

In the above equations, the upward direction of the force is indicated by a negative sign (–).

The sum of the forces F11 and F12 is calculated, as follows:

$$F11+F12=-L12\times F10/L11+(L11+L12)\times F10/L11=F10$$

The two models shown in FIGS. 9A and 9B prove that the sum of the forces respectively applied at the points P1 and P2 is normally equal to the load, regardless of the location of the load effected. When the forces F1 and F2 are effected respectively at the points P1 and P2, distortion appears on each of the beams 38*b* and 38*c*. Hence, a resistance variation occurs on each of the strain gauges 41A and 41B in proportion to each of the forces F1 and F2. Thus, it is possible to calculate the amount of the force F by using the sum of the outputs of the strain gauges 41A and 41B.

Next, the circuitry which is used to obtain the sum of the outputs of the strain gauges 41A and 41B will be described with reference to FIGS. 10A and 10B. Herein, the strain gauge 41A eventually produces an output 'Va', while the strain gauge 41B eventually produces an output 'Vb'.

Figure 10A:
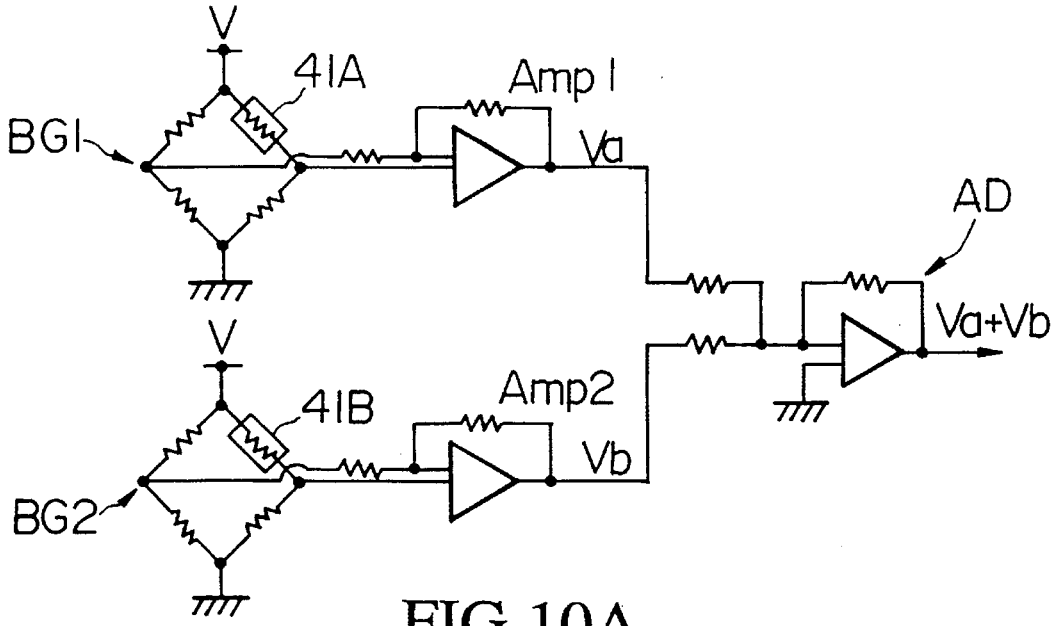
FIGS. 10A and 10B are circuit diagrams each showing a circuitry which is used to obtain a sum of outputs of two strain gauges attached to the stopper member.

In the circuitry shown in FIG. 10A, there are provided two bridge circuits BG1 and BG2 to which the same voltage 'V' is applied. Each bridge circuit contains four resistors, in which the resistor of the strain gauge is used as one resistor, while each of the other three resistors has the fixed resistance. The bridge circuit BG1, using the strain gauge 41A as its one resistor, is connected with an amplifier Amp1, which produces the output Va in response to the resistance of the strain gauge 41A. Similarly, the bridge circuit BG2, using the strain gauge 41B as its one resistor, is connected with an amplifier Amp2, which produces the output Vb in response to the resistance of the strain gauge 41B. Those outputs Va and Vb are added together by an adder circuit 'AD' which consists of a resistor and an operational amplifier. Thus, the adder circuit AD produces a sum of the outputs, i.e., "Va+Vb".

In the circuitry shown in FIG. 10A, resistance for each of the fixed resistors, used by the bridge circuits BG1 and BG2, is selected such that under the state where the load F is not applied to the stopper member 38, each of the outputs Va and Vb is set equal to zero. Thus, when the load F is effected on the lower-limit stopper 38*d* at the point P arbitrarily selected, the output Va of the strain gauge 41A responds to the partial load F1, while the output Vb of the strain gauge 41B responds to the partial load F2. Therefore, the sum of those outputs, i.e., Va+Vb, should be proportional to the load F.

The circuitry shown in FIG. 10A is designed to cope with the situation where the two strain gauges are located respectively on the two beams. Of course, this circuitry can be easily redesigned to cope with the other situation where three or more strain gauges are located respectively on the three or more beams. In that situation, a pair of the amplifier and the bridge circuit, using the strain gauge, is merely increased to three or more. Thus, the configuration of the circuitry as shown in FIG. 10A can offer an easy way to cope with any situations.

Figure 10B:
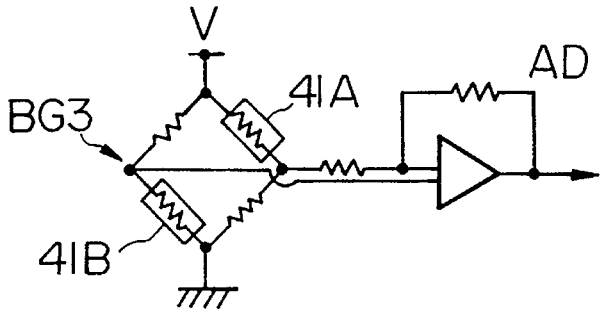

FIG. 10B shows another circuitry which is configured by one bridge circuit BG3 and the adder circuit AD. In the bridge circuit BG3, the two strain gauges 41A and 41B are used as two resistors which are located opposite to each other, while each of other two resistors has fixed resistance. In that circuitry, the adder circuit AD produces the sum of the outputs "Va+Vb". As compared to the circuitry shown in FIG. 10A, the circuitry shown in FIG. 10B is simplified in configuration.

Next, the operations of the keyboard according to the fourth embodiment which employs the aforementioned working principle will be described in detail with reference to FIGS. 6 and 7.

When the depression of the key 31 is initiated, the upper-edge portion of the stopper element 31*c* starts to depart from the felt member 37 attached to the upper-limit stopper. Then, the actuator 31*d* depresses down the projecting portion of the rubber-contact member 35 so that the key switch is turned on. If the key 31 is further depressed down by the after touch, the lower-edge portion of the stopper element 31*c* depresses down the lower-limit stopper 38*d* through the felt member 39. Thus, certain forces are respectively effected at the points P1 and P2 (see FIG. 6) of the lower-limit stopper 38*d* in response to the intensity and location of the depressing force applied. Based on those forces, the beams 38*b* and 38*c* are respectively deformed.

The base part 38*a* of the stopper member 38 is securely fixed to the keyboard frame 32; and the base part 38*a* has a sufficient thickness in the vertical direction (see FIG. 7). Hence, even if the beams 38*b* and 38*c* are deformed responsive to the depressing force, the common sub-frame 40 is not substantially deformed because the back-edge portion of the common sub-frame 40 is fixed with the base part 38*a* securely fixed.

Therefore, each of the beams 38*b* and 38*c* acts like a cantilever whose back-edge portion is supported by the base part 38*a*. If the beams 38*b* and 38*c* are further deformed in the downward direction, the lower-limit stopper 38*d* is moved downward so that a tip-edge portion of the lower-limit stopper 38*d* comes in contact with the common sub-frame 40. At that timing, the deformation of each of the beams 38*b* and 38*c* is stopped. When the beams 38*b* and 38*c* are bent, the amounts of resistance of the strain gauges 41A and 41B are varied in response to the forces F1 and F2 respectively effected on the beams 38*b* and 38*c*. Thus, the circuitry, shown in FIG. 10A or 10B, produces an output signal, corresponding to "Va+Vb", in response to the depressing force. This signal is supplied to a musical tone control circuit (not shown), by which a control for the after touch is performed responsive to the key depression in terms of the tone volume, tone color or the like.

The fourth embodiment can remarkably improve the response because only the stopper member 38, whose base part 38*a* is securely fixed with the keyboard frame 32, is deformed in response to the after touch. In addition, the depressing force, which is detected by the after touch, does not depend upon the location of the key depressed in the key-disposing direction. Therefore, the fourth embodiment can generate an after-touch control signal which is highly sensitive to the after touch with accuracy.

The fourth embodiment described above provides the two beams 38*b* and 38*c* in the stopper member 38. However, the fourth embodiment can be easily modified to provide three or more beams so that the strain gauge is located at each of those beams. In that case, outputs of the three or more strain gauges are added together to produce an output signal which responds to the depressing force. Further, the location of the strain gauge can be changed. That is, the strain gauge can be located at the lower surface of the beam. Furthermore, the sensor used by the fourth embodiment is not limited to the strain gauge. It is possible to use the photo sensor, magnetic sensor, electrostatic-capacity sensor and the like. The photo sensor contains three elements, wherein one element is attached to the lower surface of the lower-limit stopper 38*d*, and the other two elements are arranged on the common sub-frame 40.

[E] Fifth embodiment

Figure 11:
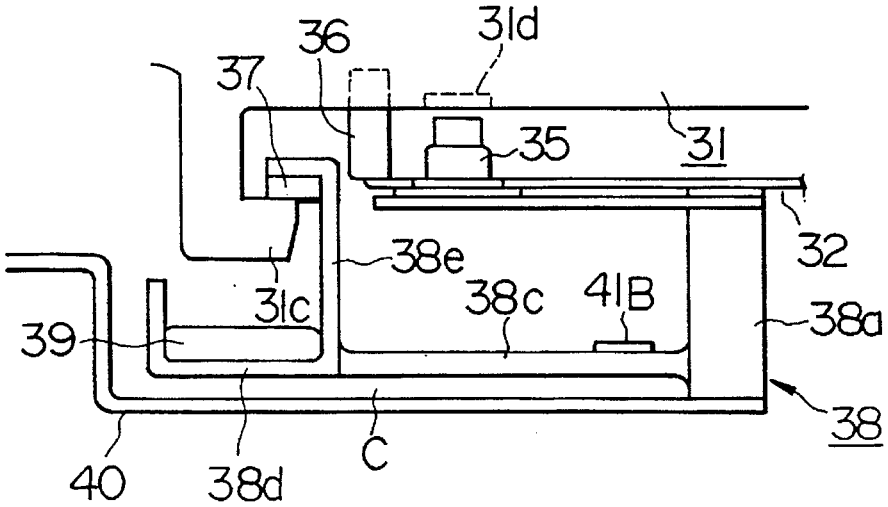
FIG. 11 is a side view illustrating an essential part of a keyboard according to a fifth embodiment.

FIG. 11 is a side view illustrating an essential part of a keyboard according to a fifth embodiment. The fifth embodiment is designed by partially modifying the fourth embodiment; hence, the parts corresponding to those shown in FIG. 7 will be designated by the same numerals.

The fifth embodiment is characterized by providing a support arm 38*e*, having a reversed-letter-"L"-like shape, in the stopper member 38. The felt member 37, which acts as the upper-limit stopper, is adhered to a lower surface of the support arm 38*e*. The other elements of the fifth embodiment are similar to those of the fourth embodiment; hence, the description thereof will be omitted.

At the key-release mode, the pressing force, which is applied to the key 31 in the upward direction by the key-return spring 33, is transmitted to the support arm 38*e* through the stopper element 31*c*. Hence, a tip-edge portion of the support arm 38*e* is lifted up by the pressing force of the key-return spring 33. Therefore, the load F (see FIG. 9A) actually applied to the stopper member 38 can be accurately calculated by subtracting the pressing force from the depressing force. If the pressing force applied to one key is equal to '70 gf' and the number of the keys depressed is represented by 'n', the downward force actually effected on the lower-limit stopper 38*d* is calculated by subtracting "n×70 gf" from the depressing force.

[F] Sixth embodiment

Figure 12:
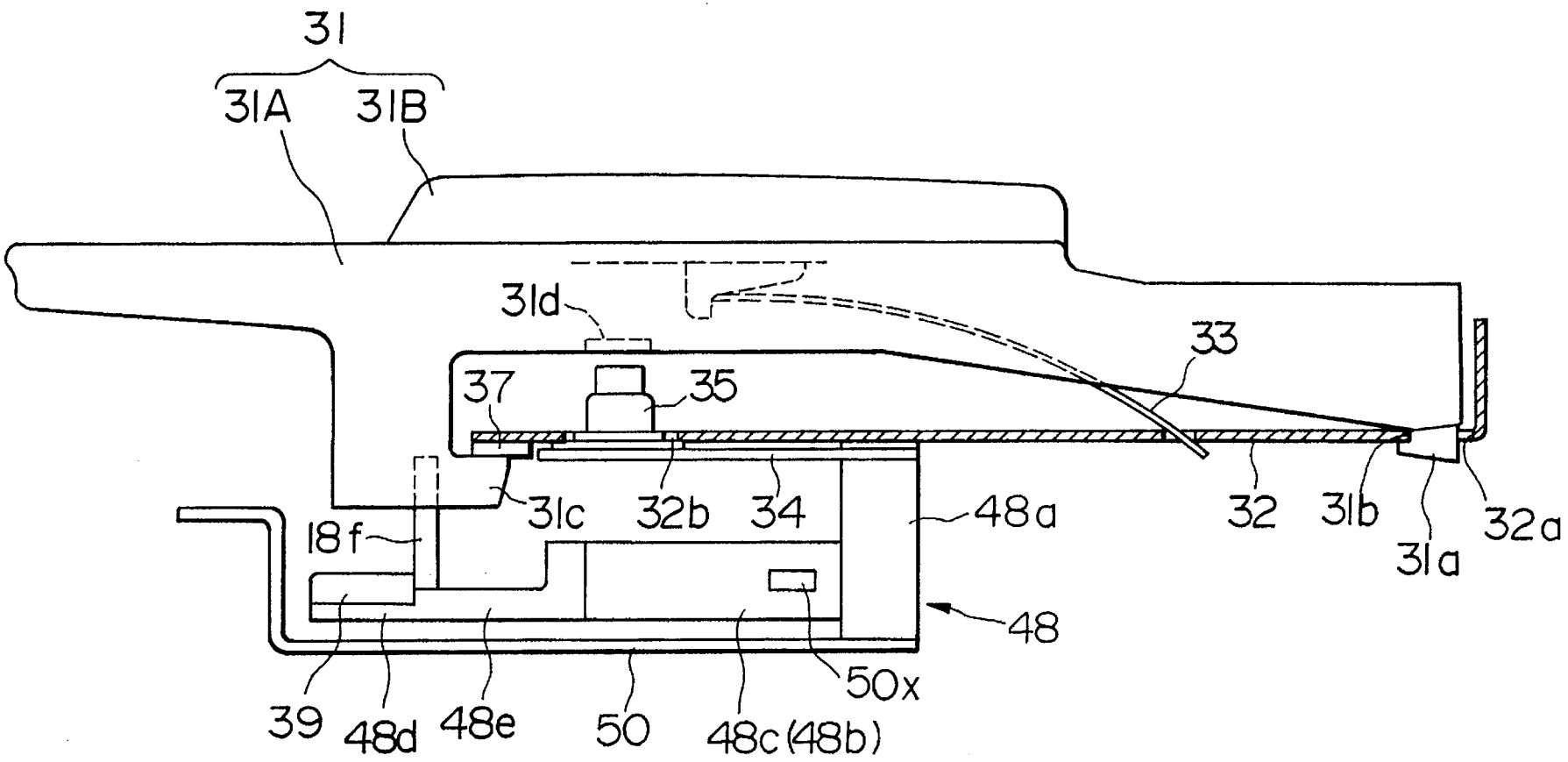
FIG. 12 is a side view illustrating an essential part of a keyboard according to a sixth embodiment.
Figure 13:
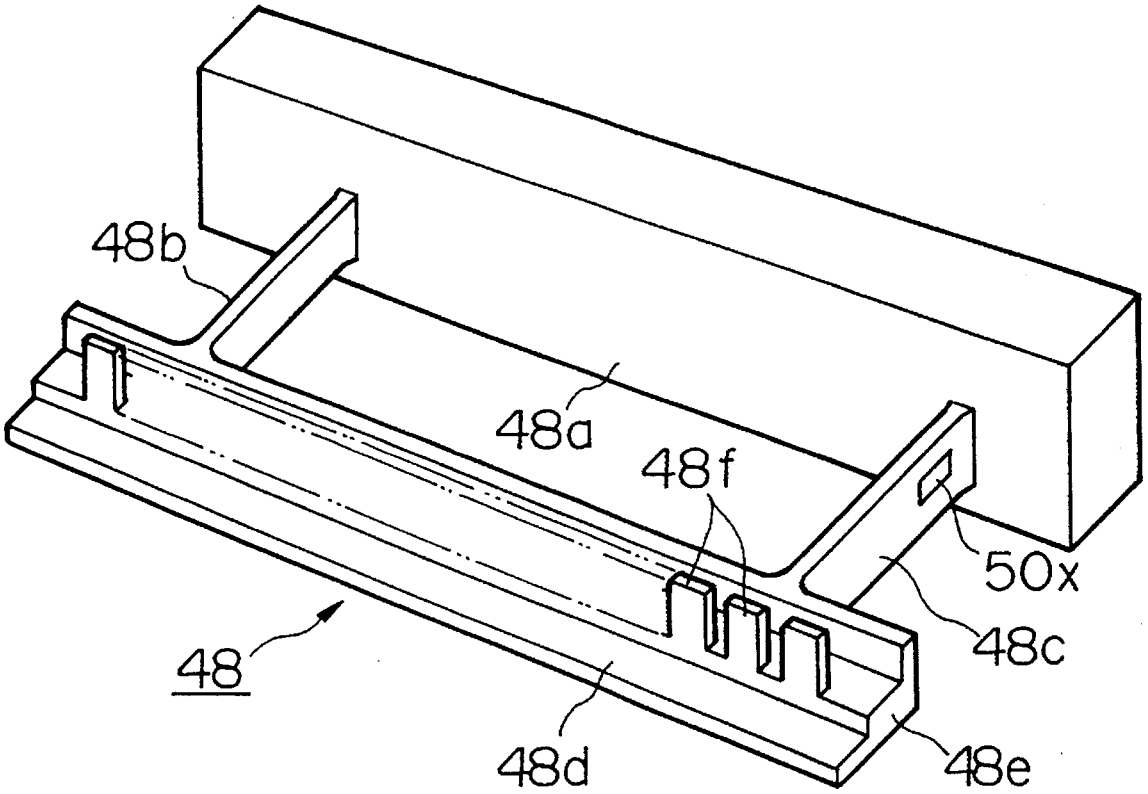
FIG. 13 is a perspective-side view illustrating a stopper member employed by the sixth embodiment.

The fourth and fifth embodiments described above are provided to perform the after-touch control by detecting the downward force effected on the lower-limit stopper 38*d* at the key-depression timing. In contrast, a sixth embodiment is provided to control the musical tone by detecting a horizontal force applied to the key at the key-depression timing or after the key-depression timing. FIG. 12 is a side view illustrating an essential part of a keyboard according to the sixth embodiment; and FIG. 13 is a perspective-side view illustrating a stopper member employed by the sixth embodiment. Incidentally, the parts corresponding to those shown in FIG. 7 will be designated by the same numerals; hence, the detailed description thereof will be omitted.

The sixth embodiment is characterized by providing a new stopper member 48 whose base part 48*a*, having a square-pole-like shape, is arranged in its longitudinal direction along the key-disposing direction. The base part 48*a* is securely fixed to the lower surface of the keyboard frame 32 at its roughly center portion. Two beams 48*b* and 48*c* are formed together with the base part 38*a* in proximity to its both-edge portions. Each of the beams 48*b* and 48*c* has flexibility in the horizontal direction with respect to the keyboard. In addition, a movable portion 48*e* is formed together with the beams 48*b* and 48*c* in such a manner that the location of the movable portion 48*e* in its longitudinal direction is set in parallel to the base part 48*a*. A strain gauge 50× is adhered to a side wall of the beam 48*c* (see FIG. 13) in proximity to the base part 48*a*. A plurality of key guides '48*f*' are disposed in line on the movable part 48*e* in response to a plurality of keys respectively. A lower-limit stopper 48*d* is formed in an extended plane of the movable portion 48*e*. A felt member 49 is adhered onto an upper surface of the lower-limit stopper 48*d*.

Now, when the performer applies the horizontal force to the key 31 at the key-depression timing or after the key-depressing timing, the horizontal force applied to the key 31 is transmitted to the movable portion 48*e* through the key guide 48*f*. Thus, the beams 48*b* and 48*c* are bent in the horizontal direction. The resistance of the strain gauge 50×, which is attached to the side wall of the beam 48*c* in proximity to the base part 48*a*, is varied in response to the amount of the horizontal force applied to the key 31. Based on the resistance variation of the strain gauge 50×, the musical tone is controlled in pitch. Hence, it is possible to realize a delicate variation in pitch of the musical tone, such as the vibrato, with high response.

The sixth embodiment provides the strain gauge 50× which is attached to the side wall of the beam 48*c* only. Of course, it is possible to further attach another strain gauge at a side wall of the beam 48*b*. In that case, the output of the sensor can be doubled. In the sixth embodiment, the strain gauge is attached to an exterior side wall of the beam. Of course, it is possible to attach the strain gauge to an interior side wall of the beam.

[G] Seventh embodiment

Figure 14:
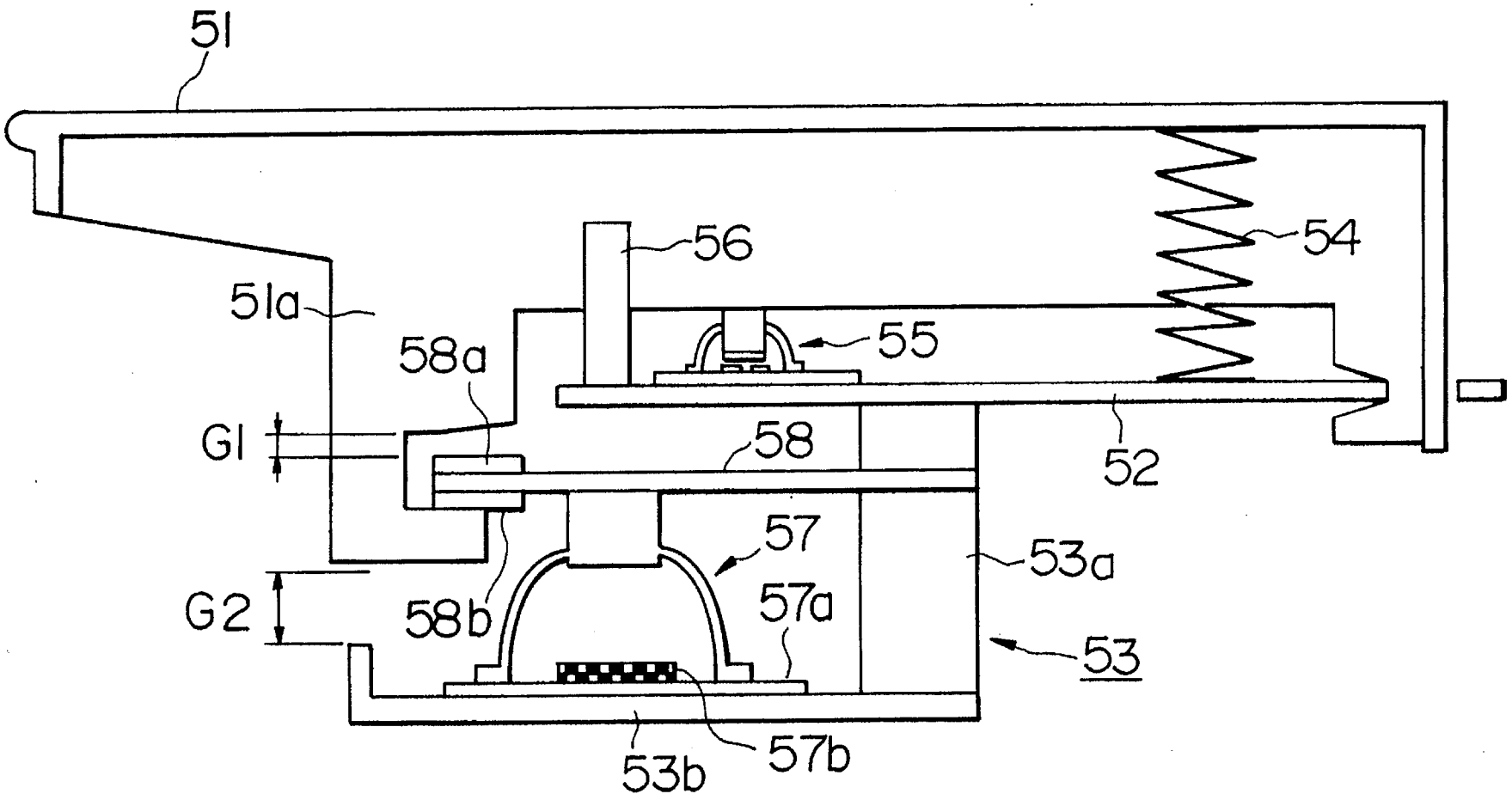
FIG. 14 is a side view illustrating a sectional construction of an essential part of a keyboard according to a seventh embodiment.

FIG. 14 is a side view illustrating a sectional construction of an essential part of a keyboard according to a seventh embodiment. Under a key 51, there is provided a stopper member 53, whose base part 53*a* is securely fixed to a keyboard frame 52. The key 51 is normally pressed upward by a coil spring 54 which produces approximately '55 gf' of pressing force. On the keyboard frame 52, a silicon-rubber contact 55 and a key guide 56 are arranged. The silicon-rubber contact 55 is provided to detect an key-on event or a key-off event for the key 51. A bedplate 53*b*, having a roughly letter "L" like shape, is attached to a lower surface of the base part 53*a*. On the bedplate 53*b*, there is provided a photo sensor 57 whose substrate 57*a* is attached to an upper surface of the bedplate 53*b*. Inside of the photo sensor 57, there is provided a photo reflector 57*b* which consists of a pair of photo elements fabricated on the substrate 57*a*; hence, light emitted from a photo diode is reflected and is received by a photo transistor. A plate spring 58 is fixed to the base part 53*a* at a selected elevation and is located such that an edge portion thereof is inserted in a recess of a stopper element 51*a* of the key 51. An upper-edge portion 58*a* of the plate spring 58 acts as an lower-limit stopper when the key 51 is depressed so that the upper-edge portion 58*a* comes in contact with an upper-interior wall of the recess of the stopper element 51*a*. A lower-edge portion 58*b* of the plate spring 58 acts as an upper-limit stopper when the key 51 is returned to a normal position by the coil spring 54 so that the lower-edge portion 58*b* comes in contact with a lower-interior wall of the recess of the stopper element 51*a*.

In a key-depression event, the upper-interior wall of the recess of the stopper element 51*a* comes in contact with the upper-edge portion 58*a* of the plate spring 58 and further depresses down the plate spring 58 against its pre-tension force. In that case, the plate spring 58 is slightly bent and deformed in the downward direction. This downward deformation of the plate spring 58 is detected by the photo sensor 57. An output of the photo sensor 57, which responds to the downward force applied to the key 51, is used to control the musical tone in terms of a specific musical element.

Figure 15:
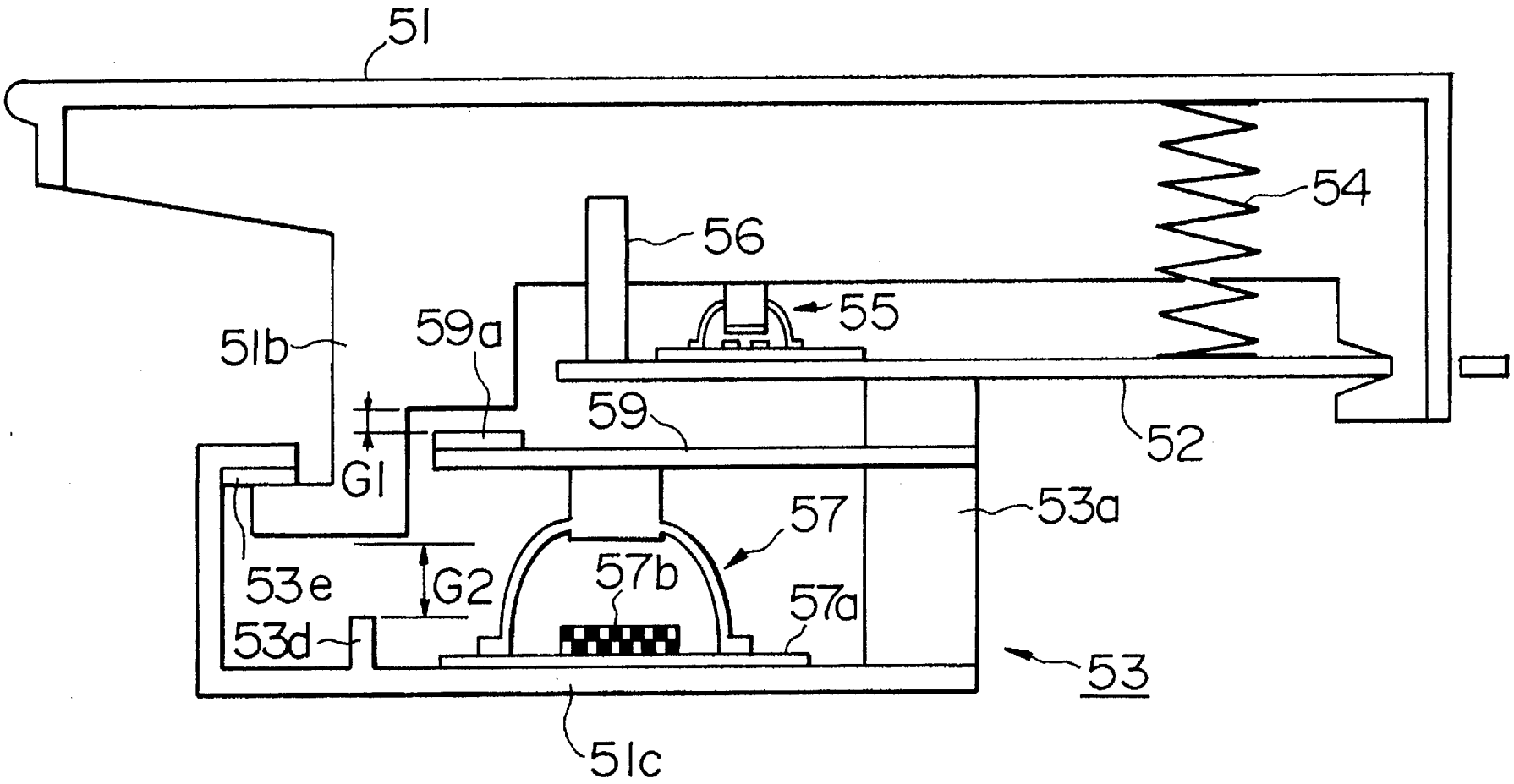
FIG. 15 is a side view illustrating an essential part of a keyboard according to a modified example of the seventh embodiment.

FIG. 15 is a side view illustrating a modified example of the seventh embodiment described above. In FIG. 15, a bedplate 53*c* is attached to the lower surface of the base part 53*a* of the stopper member 53. Different from the bedplate 53*b*, the bedplate 53*c* comprises a fixed stopper 53*d* and a tip-edge portion 53*e*. A plate spring 59 is fixed to the base part 53*a* at an selected elevation, wherein an upper-edge portion 59*a* acts as a lower-limit stopper when the key 51 is depressed so that the upper-edge portion 59*a* comes in contact with a step surface of a stopper element 51*b*. The fixed stopper 53*d* provides a terminal stopper for the key 51 in order to prevent the plate spring 59 from being destructed by an over-bent event. The tip-edge portion 53*e* acts as an upper-limit stopper when the key 51 is returned to the original position by the coil spring 54 so that the tip-edge portion 53*e* comes in contact with a certain upper surface of the stopper element 51*b*. The operations of the modified example shown in FIG. 15 are similar to those of the seventh embodiment shown in FIG. 14; hence, the description thereof will be omitted.

Incidentally, the photo sensor 57 can be replaced by a strain gauge, which is attached to a surface of the plate spring 58 or 59. Because, the strain gauge can detect the downward force applied to the plate spring 58 or 59.

As compared to the foregoing embodiments, the seventh embodiment is characterized by that a first gap G1 is set smaller than a second gap G2 in order to provide a play for the depression of the key made by the human. Herein, the first gap G1 is provided between the upper-edge portion 58*a* of the plate spring 58 and the upper-interior wall of the recess of the stopper element 51*a* in FIG. 14 (or between the upper-edge portion 59*a* of the plate spring 59 and the step surface of the stopper element 51*b* in FIG. 15). The first gap G1 ranges from '1 mm' to '2 mm'. When the key 51 is depressed so that the upper-interior wall of the recess of the stopper element 51*a* comes in contact with the upper-edge portion 58*a* of the plate spring 58, the second gap G2 appears between the lower surface of the stopper element 51*a* and a tip-edge portion of the bedplate 53*b* in FIG. 14. Similarly, when the key 51 is depressed so that the step surface of the stopper element 51*b* comes in contact with the upper-edge portion 59*a* of the plate spring 59, the second gap G2 appears between the lower surface of the stopper element 51*b* and a tip-edge portion of the fixed stopper 53*d*.

Next, the detailed description will be given with respect to the relationship between the gaps G1 and G2. Basically, those gaps are provided on the ground of the requirement of the human engineering.

In general, when the human stimulates flesh to move his finger to depress the key, a certain amount of force (hereinafter, referred to as external force) is applied to the key which is provided outside of the finger (or flesh). In that case, the external force actually applied to the key can be calculated by subtracting internal force, which is required inside of the flesh to be moved, from overall power of flesh which is produced by the flesh as a whole. The internal force depends upon the visco-elasticity and mass of the flesh. In addition, the visco-elasticity alters responsive to the tension produced by the flesh, length of the flesh and contraction speed of the flesh. Further, the visco-elasticity is controlled by the simultaneous actions of the main-active flesh and antagonistic flesh.

The external force appears on the point of application by means of a bone-link structure formed by bones of the human. In other words, the external force, appeared on the point of application, alters in accordance with deformation in the bone-link structure.

In an event of the depression of the key providing the play (i.e., gaps G1, G2), the flesh is moving continuously while the bone-link structure is altering as well; hence, the external force appeared on the point of application is changing. This indicates that the player can accurately control the external force, which is transmitted from the finger tip to the key, through experiences in practice to play the keyboard. In the practice, the player learns how to control the flesh of the finger and how to control the bent shape of the finger.

In contrast, the keyboard having no play is not substantially affected by the movement of the flesh and the deformation of the bone-link structure in the key-depression event. Because, such keyboard is hardly affected by visco-elasticity and mass of the flesh. The above-mentioned matter indicates that as compared to the conventional keyboard having the play, the keyboard having no play may perform a fine control on the force produced by the finger tip. The seventh embodiment provides an example of the keyboard having substantially no play.

Therefore, the keyboard according to the seventh embodiment can transmit the intended touch to the key because this keyboard is designed to transmit the force to the key without causing the deformation of the bone-link structure. Hence, the force of touch intended can be accurately sensed by the sensor and is reflected by the control of the musical tone.

Actually, however, the seventh embodiment is designed such that a certain play is provided in a short-stroke range within an overall stroke in the depression of key. This is because the normal player for the keyboard bas practices in playing the conventional keyboard having the play, wherein the overall stroke is approximately equal to '10 mm'. In the acoustic pianos conventionally known, the depression of key can be made by the certain amount of force ranging from '50 gf' to '60 gf'. The same thing can be said to the organs and the like. Therefore, the keyboard employed by the electronic musical instrument is designed such that the depression of key can be made by the aforementioned load or the like. In short, the present embodiment is characterized by that the keyboard is designed to substantially have no play but to have a small play which corresponds to that of the conventional keyboard.

Hence, the keyboard according to the present embodiment can provide a small play, which corresponds to the play of the conventional keyboard, in an initial stage of the depression of key. Specifically, the present embodiment provides a play of '1 mm' in response to the load ranging from '50 gf' to '100 gf'. After the initial stage of the depression of key, a certain rate for the depression of key is set at '1.5 mm' to '5 mm' per unit load of '1 Kg'. In the progress of the further depression of key, the depressing force is applying to the key, while the finger depressing the key is feeling the reaction from the key. The force corresponding to that reaction is sensed by the sensor. The aforementioned first gap G1 is provided to respond to the small play of the keyboard which emerges in the initial stage of the depression of key, while the second gap G2 is provided to respond to the distance of '1.5 mm' to '5 mm' in the depression of key for the unit load of '1 Kg'. These numbers of the distance are obtained through experimental performances of the keyboard. The strong depression of key which is made when realizing fortissiom (fff) is equivalent to the load of '2 Kg' or so; and the remained stroke for the depression of key ranges from '3 mm' to '10 mm'. When the remained stroke is set at a small distance, which is smaller than 3 mm, the player may feel that the key is 'hard' to depress. In that case, the finger of the player is easily damaged by the 'hard' key; and the player may be easily tired of playing the keyboard. On the other hand, when the remained stroke is set at a large distance, which is larger than 10 mm, the player may feel that the key is 'soft' to depress. In that ease, a relatively big time lag may occur between the key-depression moment and sound-producing moment; in other words, the control for the musical tone is delayed. Therefore, the aforementioned numbers, which are obtained through the experiments in playing the keyboard, are significant numbers when designing the keyboard.

Incidentally, a certain set of the aforementioned construction elements (i.e. 2, 4, 4*a*, 7; 24, 24*a*, 38*d*, 40, 32; 48, 50, 48*a*; 52, 53, 53*a*, 53*b*, 53*c*) can be formed together as one member, which may be called "keyboard-frame means" or "support member".

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone control device for an electronic keyboard instrument comprising:

a keyboard frame rotatably supporting at least one key such that said key can rotate vertically with respect to said keyboard frame, said key being pressed in an upward vertical direction by a return spring;

a stopper member comprising a base portion fixedly secured to said keyboard frame, an edge portion, and a vertically flexible portion located between said base portion and said edge portion, said edge portion including an upper limit stopper disposed so as to stop rotation of said key in said upward vertical direction and a lower limit stopper disposed so as to stop rotation of said key in a downward vertical direction; and sensor means for sensing an upward force applied by said key to said upper limit stopper and a downward force applied by said key to said lower limit stopper, said sensor means producing a control signal corresponding to said sensed forces, said control signal being used to control generation of a musical tone in accordance with a specific musical parameter.

2. A musical tone control device for an electronic keyboard instrument according to claim 1, wherein said key is moveable in a horizontal direction with respect to said keyboard frame;

said stopper member further comprises a key guide member to regulate a horizontal motion of said key and a horizontally flexible portion located between said base portion and said vertically flexible portion; and said sensor means further senses a horizontal force applied to said key and transmitted to said stopper member through said key guide member, said sensor means producing another control signal therefrom, said other control signal also being used to control generation of said musical tone in accordance with said specific musical parameter.

3. A musical tone control device according to claim 1, wherein said sensor means comprises a strain gauge.

4. A musical tone control device according to claim 1, wherein said sensor means comprises a photo sensor which senses a vertical deformation of said stopper member.

5. A musical tone control device according to claim 1, wherein said specific musical parameter comprises a pitch.

6. A musical tone control device for an electronic keyboard instrument comprising:

a keyboard frame rotatably supporting at least one key such that said key can rotate vertically with respect to said keyboard frame, said key being pressed in an upward vertical direction by a return spring;

a stopper member comprising a base portion fixedly secured to said keyboard frame, a lower limit stopper disposed so as to stop rotation of said key in a downward vertical direction, and a vertically flexible portion located between said base portion and said lower limit stopper, said vertically flexible portion comprising a plurality of vertically flexible beams;

a plurality of sensors disposed on said plurality of vertically flexible beams, each said sensor sensing an amount of deformation of the vertically flexible beam on which said sensor is disposed; and adder means for adding outputs of said plurality of sensors to produce a signal representing a force of said key against said lower limit stopper, said control signal being used to control generation of a musical tone in accordance with a specific musical parameter.

7. A musical tone control device for an electronic keyboard instrument according to claim 6, wherein at least one of said plurality of sensors comprises a strain gauge.

8. A musical tone control device for an electronic keyboard instrument according to claim 6, wherein said specific musical parameter is pitch.

9. A musical tone control device for an electronic keyboard instrument comprising:

a keyboard frame movably supporting at least one key such that said key can move vertically and horizontally with respect to said keyboard frame, said key being pressed in an upward vertical direction by a return member;

a stopper member comprising a base portion fixedly secured to said keyboard frame, a key guide for regulating a horizontal motion of said key, and a lower limit stopper disposed so as to stop movement of said key in a downward vertical direction, said lower limit stopper being connected to said base portion by a plurality of beams each flexible in a horizontal direction; and at least one sensor disposed on at least one of said plurality of beams for sensing a horizontal force applied to at least one of said beams through said key guide when said key is moved horizontally, whereby an output of said sensor is used to control a musical tone in accordance with a specific musical parameter.

10. A musical tone control device for an electronic keyboard instrument comprising:

a keyboard frame rotatably supporting at least one key such that said key can rotate vertically with respect to said keyboard frame, said key being pressed upward by a return member;

a detector disposed on an upper surface of said keyboard frame for detecting depression of said key;

a stopper member disposed below said keyboard frame for providing a lower limit stopper and an upper limit stopper for said key, said stopper member comprising a base part, a bedplate and a plate spring, said base part being securely fixed to a lower surface of said keyboard frame, said bedplate being fixed to said base part such that said bedplate is supported horizontally, a first end of said plate spring being securely fixed to said base part between said keyboard frame and said bedplate so that a second end of said plate spring can flex in a vertical direction; and a photo sensor disposed on an upper surface of said bedplate between said plate spring and said bedplate for sensing a vertical deformation of said plate spring when said second end of said plate spring is vertically pressed by said key, whereby an output of said photo sensor is used to control a musical tone in accordance with a specific musical parameter.

11. A musical tone control device for an electronic keyboard instrument comprising:

a support member movably supporting at least one key such that said key can move vertically with respect to said support member, said key being pressed upward into a first position by a pressing member;

a stopper member comprising a base part securely fixed to said support member and a vertically flexible part having a first end fixed to said base part and a free end opposite said first end, said free end forming a lower limit stopper for stopping downward movement of said key, said vertically flexible part being vertically deformed in response to a downward force of said key against said lower limit stopper;

a sensor for sensing a deformation of said vertically flexible part caused by said downward force of said key against said lower limit stopper, an output of said sensor controlling generation of a musical tone in in accordance with a specific musical parameter, wherein a distance between said first position and a position in which a lower surface of said key initially contacts said lower limit stopper is 5 mm or less by force of at least 100 gf, and said lower limit stopper moves 1.5–5 mm per unit load of 1 Kg downward force against said key as said key continues to contact said lower limit stopper.

12. A musical tone control device for an electronic keyboard instrument comprising:

a support member movably supporting at least one key such that said key can move vertically with respect to said support member along a key stroke path, said key being pressed upward by a pressing member;

a vertically flexible member disposed below said key, a first end of said vertically flexible member being securely fixed to said support member such that said vertically flexible member is disposed horizontally a selected distance below said support member, a second end of said vertically flexible member being free to move vertically in response to depression of said key against said vertically flexible member;

a lower limit stopper formed at said second end of said vertically flexible member, said lower limit stopper regulating a downward movement of said key a distance corresponding to one half or less of a length of said key stroke path; and a photo sensor for sensing a downward deformation of said vertically flexible member, whereby an output of said photo sensor is used to control a musical tone in in accordance with a specific musical parameter.

13. A musical tone control device for an electronic keyboard instrument comprising:

a support member supporting at least one key such that said key can move vertically up and down with respect to said support member along a key stroke path, said key being pressed upward by a pressing member;

a vertically flexible member disposed below said key, a first end of said vertically flexible member being securely fixed to said support member such that said vertically flexible member is disposed a selected distance below said support member, a second end of said vertically flexible member being free to move vertically in response to depression of said key against said vertically flexible member;

a lower limit stopper formed at an upper surface of said second end of said vertically flexible member, said lower limit stopper regulating a downward movement of said key a distance corresponding to a half or less of a distance of said key stroke path;

an upper limit stopper formed at a lower surface of said second end of said vertically flexible member, said upper limit stopper regulating an upward movement of said key a distance corresponding to a half or less of said distance of said key stroke path; and a photo sensor for sensing a vertical deformation of said vertically flexible member, whereby an output of said photo sensor is used to control a musical tone in in accordance with a specific musical parameter.

* * * * *